United States Patent [19]

Tiljander

[11] Patent Number: 4,700,613

[45] Date of Patent: Oct. 20, 1987

[54] HYDRAULIC MOTOR WITH STATIONARY AXLE AND ROTATING FLUID DISTRIBUTOR

[75] Inventor: Ossi Tiljander, Iisalmi, Finland

[73] Assignee: Oy Partek AB, Finland

[21] Appl. No.: 900,253

[22] Filed: Aug. 22, 1986

Related U.S. Application Data

[63] Continuation of Ser. No. 678,713, Dec. 6, 1984, abandoned.

[30] Foreign Application Priority Data

Dec. 7, 1983 [FI] Finland ..... 834477

[51] Int. Cl.[4] ..... F01B 1/06

[52] U.S. Cl. ..... 91/485; 91/491; 180/308

[58] Field of Search ..... 91/491, 487, 472, 485; 180/242, 308

[56] References Cited

U.S. PATENT DOCUMENTS

| | | | |
|---|---|---|---|
| 3,511,131 | 5/1970 | Kress | 91/472 |
| 3,693,507 | 9/1972 | Kress | 91/180 |
| 3,895,565 | 7/1975 | Schoffler | 91/492 |
| 4,009,643 | 3/1977 | Thumm | 91/492 |
| 4,136,602 | 1/1979 | Lenz | 91/491 |
| 4,171,732 | 10/1979 | Pinson | 91/491 |
| 4,326,450 | 4/1982 | Bacquie | 91/487 |
| 4,505,185 | 3/1985 | Jacobs | 91/491 |
| 4,522,110 | 6/1985 | Samuelsson | 91/491 |
| 4,528,893 | 7/1985 | Neumann | 91/180 |

FOREIGN PATENT DOCUMENTS

| | | | |
|---|---|---|---|
| 2537552 | 3/1977 | Fed. Rep. of Germany | 91/491 |
| 1285698 | 8/1972 | United Kingdom | 91/491 |
| 1399596 | 7/1975 | United Kingdom | 91/491 |
| 2086991 | 5/1982 | United Kingdom | 91/491 |

*Primary Examiner*—Carlton R. Croyle
*Assistant Examiner*—Paul F. Neils
*Attorney, Agent, or Firm*—Scully, Scott, Murphy & Presser

[57] ABSTRACT

The invention relates to a hydraulic motor, which comprises a surrounding frame casing; an internal cylinder block with radially arranged cylinders and a stationary axle of the hydraulic motor attached thereto; pistons reciprocating in the cylinders and bearing the inner surface of the frame casing, which surface is formed as a running surface guiding the movement of the pistons; a fluid distributor mounted around the axle to rotate together with the frame casing, for the distribution of the hydraulic fluid into cylinder chambers and away therefrom via openings provided in the cylinder block; and feed and exhaust channels for the hydraulic fluid. The object of the invention is to improve such a hydraulic motor by compensating, without complicated balancing elements, the force caused by the pressurized hydraulic fluid and separating the fluid distributor and the cylinder block. This has been solved according to the invention in such a manner that a ring space is formed between the fluid distributor and the axle, by means of stepped counter surfaces of the axle and the fluid distributor, said ring space being formed in the feed channel for the hydraulic fluid.

4 Claims, 3 Drawing Figures

HYDRAULIC MOTOR WITH STATIONARY AXLE AND ROTATING FLUID DISTRIBUTOR

This application is a continuation of application Ser. No. 678,713, filed Dec. 6,1984, now abandoned.

The invention relates to a hydraulic motor which comprises a surrounding frame casing; an internal cylinder block with radially arranged cylinders and a stationary axle of the hydraulic motor attached thereto; pistons reciprocating in the cylinders and bearing the inner surface of the frame casing, which surface is formed as a running surface guiding the movement of the pistons; a fluid distributor mounted around the axle to rotate together with the frame casing, for the distribution of the hydraulic fluid into cylinder chambers and away therefrom via openings provided in the cylinder block; and feed and exhaust channels for the hydraulic fluid.

In this type of known hydraulic motors, efforts have been made to counterbalance the force separating the distribution surface between the fluid distributor and the cylinder block by means of various balancing elements. A common feature and disadvantage of said balancing elements is their complicated structure.

The object of the present invention is to improve a hydraulic motor of the above-mentioned type by eliminating the complicated balancing elements and the disadvantages and difficulties caused thereby and to provide a hydraulic motor with lower production costs and reliable operation simultaneously counterbalancing the force separating the distribution surface between the fluid distributor and the cylinder block.

These objects have been achieved by means of the invention in such a manner that at least one ringshaped space is provided between the fluid distributor and the axle, said space being formed at least in the feed channel for the hydraulic fluid, and that the ring space is formed by stepwise formations of the counter surfaces of the fluid distributor and the axle.

One advantage of the present invention is that no separate balancing elements are required for balancing the fluid distributor and pressing it against the cylinder block, but the force separating the fluid distributor and the cylinder block is compensated by the force caused by the hydraulic fluid on the cylinder block side wall of the ring space.

According to one preferred embodiment of the invention, two separate ring spaces are provided between the fluid distributor and the axle, one in the feed channel and the other in the return channel. Thereby, a hydraulic motor is provided, wherein the fluid distributor is balanced regardless of the direction of operation of the motor. The direction of operation of the motor is thereby changed simply in such a manner that the channel which was previously acting as a feed channel is turned into an exhaust (return) channel and the channel which was previously acting as an exhaust channel is turned into a feed channel.

Figure 1:
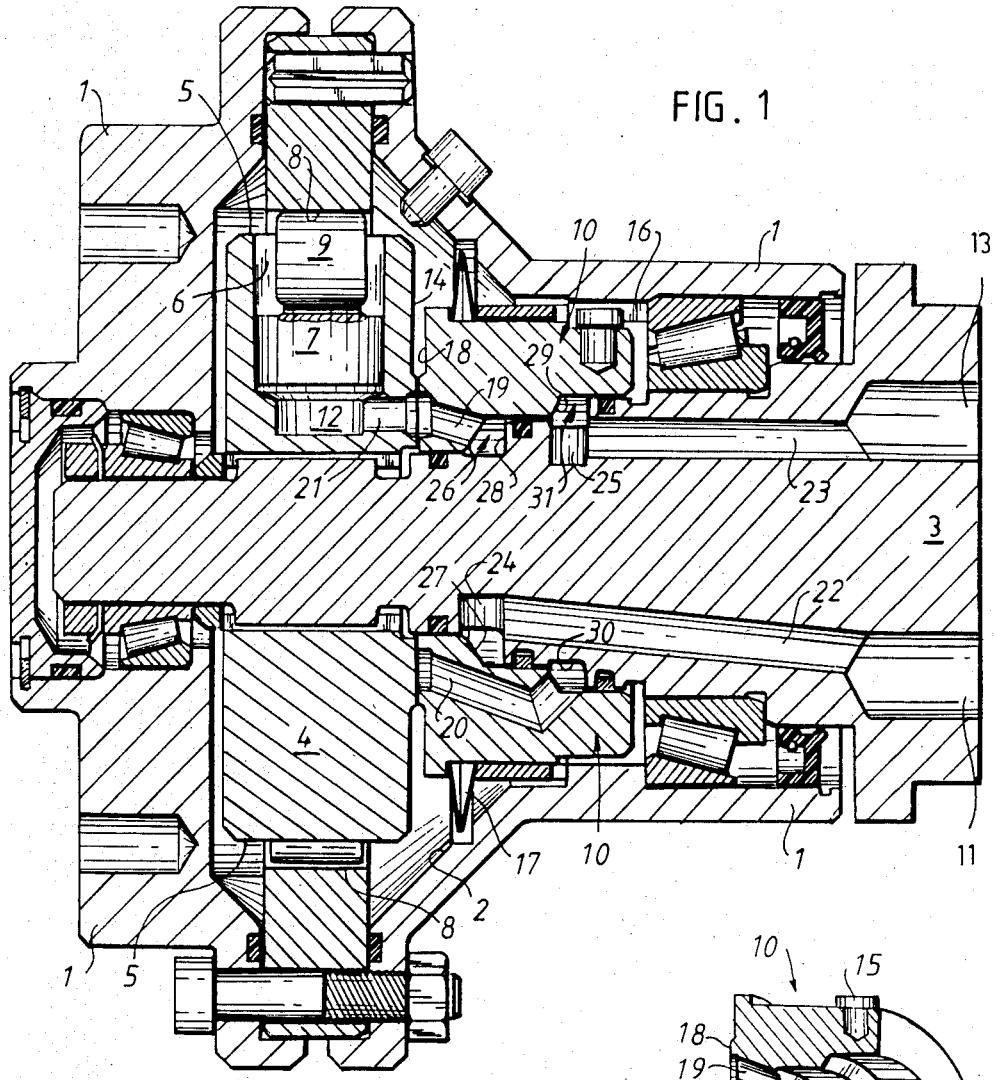
Figure 3:
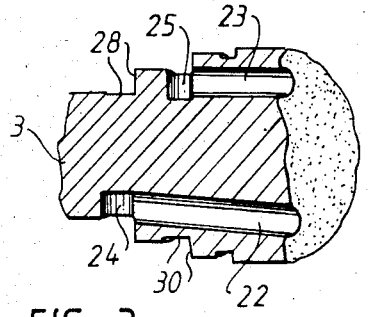
Figure 2:
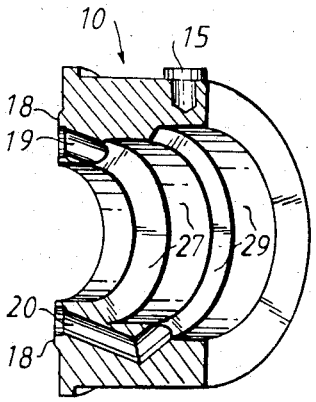

In the following the invention will be described in more detail referring, by way of example, to the attached drawing, wherein FIG. 1 is cross-sectional side-view of a hydraulic motor according to the invention, FIG. 2 is a cross-sectional perspective view of a fluid distributor used in a hydraulic motor according to the invention, and FIG. 3 is perspective view of that portion of the axle of the hydraulic motor according to the invention which is positioned inside the fluid distributor.

The hydraulic motor according to FIG. 1 comprises a rotatory cylindrical frame casing 1, which is concentrically mounted on a stationary axle 3 of the hydraulic motor. Said hydraulic motor further comprises a cylinder block 4 fitted inside the frame casing 1 and stationary fixed on the axle 3 of the hydraulic motor, e.g. by means of a suitable cotter joint. The cylinder block 4 has a cylindrical shape and a set of radial cylinders 6 is provided at its outer periphery 5, the pistons 7 of said cylinders reciprocating during the operation of the hydraulic motor, bearing at a running surface 8, a cam ring, which is provided on the inner surface of the frame casing 1 and which guides the movement of the pistons 7 by means of roller means 9 mounted on the pistons 7. The running surface 8 is shaped so as to guide the reciprocating movement of the pistons 7 between upper and lover dead points in order to effect a rotation movement of the frame casing 1. Rollers 9 may in the lateral direction be guided in a conventional manner not indicated in FIG. 1.

The fluid distributor 10, which guides the flow of the hydraulic fluid from the feed channel 11 to cylinder chambers 12 and away therefrom to an exhaust channel 13 for the hydraulic fluid, is positioned concentrically with and around the axle 3 against one radial side surface 14 of the cylinder block 4. The fluid distributor 10 is locked to rotate together with the frame casing 1 by means of a shoulder bolt 15 provided in the fluid distributor 10, said bolt extending into a counter recess 16 provided in the frame casing 1. The fluid distributor 10 is spring-loaded by means of a plate spring 17 against the cylinder block 4 in order to hold the counter surfaces 18 and 14 of the fluid distributor 10 and the cylinder block 4, respectively, in tight contact with each other and in order to prevent the hydraulic fluid from escaping from the channel sets 11, 13 for the hydraulic fluid also when the hydraulic motor is non-operative.

As shown in FIG. 1 and 2, the fluid distributor 10 of the hydraulic motor according to the invention is provided with first bores 19 and second bores 20 extending through said distributor in the axial direction and alternating circumferentially. One end of the first bores 19 opens into the feed channel 11 of the hydraulic fluid and the other end into an opening 21 provided in that wall of the cylinder block 4 which faces the counter surface 18 of the fluid distributor 10, said opening communicating with the cylinder chamber 12 and therein with the portion thereof which is below the lower dead point of the piston 7. One end of the second bores 20 opens into the exhaust channel 13 of the hydraulic fluid and the other end, similarly to said first bores 19, into the cylinder chamber via the opening 21 provided in the wall of the cylinder block 4. The number of first bores 19, as well as of second bores 20, equals the number of cams in the cam ring 8.

As appears from FIGS. 1 and 3, the feed and exhaust channels 11 and 13 provided for the hydraulic fluid in the axle 3 continue as axial bores 22 and 23 which at the fluid distributor 10 end in radial bores 24 and 25 provided on the outer periphery of the axle 3, the bore 24 communicating with the bores 19 of the fluid distributor 10 and the second bore 25 with the bores 20 of the fluid distributor 10.

As the fluid distributor 10 rotates while the cylinder block 4 and the axle 3 attached thereto are stationary, the bores 19 and 20 of the fluid distributor 10 provide periodical connections between the feed channel 11 and the cylinder chamber 12, and between the cylinder chamber 12 and the exhaust channel 13, in order to feed the hydraulic fluid into the cylinder chamber 12 to force the piston 7 to move towards its upper dead point, to effect the torgue rotating the frame casing 1, and, further, to enable the hydraulic fluid to be discharged while the piston 7 guided by the running surface 8 is moving towards its lower dead point.

The pressurized hydraulic fluid in the feed channel 11 causes a force tending to separate the surfaces 14 and 18 of the cylinder block 4 and the fluid distributor 10 respectively. According to the invention, this problem is avoided by forming a ring space 26 between the axle 3 and the fluid distributor 10, which space continuously communicates with the feed channel 11 for the hydraulic fluid and the bores 19 of the fluid distributor.

The ring space 26 comprises stepped counter surfaces 27, 28 of the axle 3 and of the fluid distributor 10 so that the ring space 26 is in the radial direction defined by the axial surfaces of the stepped counter surfaces 27, 28 of the fluid distributor 10 and the axle 3, and in the axial direction correspondingly by the radial surfaces thereof, whereby the pressurized hydraulic fluid fed into the ring space 26 acts on the end surfaces 27 thereof and presses the plane distributor 10 against the counter surface 14 of the cylinder block 4, thereby compensating the force separating the counter surfaces 14 and 18.

According to a preferred embodiment of the invention, two ring-shaped spaces 26, 31 are provided between the fluid distributor 10 and the axle 3, the first space 26 thereof communicating with the feed channel 11 for the hydraulic fluid and the bores 19 of the fluid distributor, the second space 31 communicating with the bores 20 of the fluid distributor and the exhaust channel 13 for the hydraulic fluid.

In this preferred embodiment, that surface of the fluid distributor 10 of the hydraulic motor according to the invention which is towards the axle 3 is formed by a stepped internal peripheral surface 27, 29 expanding axially in the direction away from the cylinder block 4, as more clearly appears from FIG. 2, and the surface of the axle 3 facing the fluid distributor 10 is likewise formed by a stepped outer periphery 28, 30 expanding axially in the direction away from the cylinder block 4, as more clearly appears from FIG. 3.

Thereby the first ring-shaped space 26 is formed between the axial and radial surfaces of the first stepped surface 27 of the fluid distributor 10 and the first stepped surface 28 of the axle 3, the second ringshaped space 31 being formed between the axial and radial surfaces of the second stepped surface 29 of the fluid distributor 10 and the second stepped surface 30 of the axle 3.

According to the invention, the area of the radial end surfaces of the ring-shaped spaces 26 and 31, which surfaces face the cylinder block 4, are preferably of equal size, whereby the fluid distributor 10 is tightly pressed against the counter surface 14 of the cylinder block under the influence of the pressure caused by the hydraulic fluid, regardless of which one of the channels 11, 13 is used as a feed channel and which one as an exhaust channel. This advantageous dimensioning of the ring spaces 26, 31 provides a hydraulic motor which can be operated in both directions, in which motor the fluid distributor 10 is continuously tightly pressed against the cylinder block 4.

This end surface of the ring-shaped space 26, 31 facing the cylinder block is, according to the preferred embodiment of the invention, so dimensioned that the force which is caused by the pressurized hydraulic fluid and which presses the fluid distributor 10 against the cylinder block 4 compensates the force separating the fluid distributor 10 and the cylinder block 4. Consequently, the fluid distributor 10 is continuously balancedly pressed against the cylinder block 4 in the direction of operation of the motor.

The invention is described above by means of its preferred embodiment. The intention here has in no way been to restrict the invention; on the contrary, diverse variations and combinations are possible within the scope of the inventive idea defined in the accompanying claims, as apparent to one skilled in the art.

In particular, it is to be noted that the mutual arrangement of the components of the hydraulic motor itself may vary considerably with respect to the above examplary case. Accordingly, the axle and the cylinder block, for instance, can be rotatary, the fluid distributor and the frame casing being stationary.

I claim:

1. A hydraulic motor, comprising:

a surrounding rotatable frame casing;

a stationary internal cylinder block with radially arranged cylinders and a stationary axle of the hydraulic motor attached thereto;

pistons reciprocating in the cylinders and bearing the inner surface of the frame casing, said inner surface being formed as a running surface guiding the movement of the pistons;

feed and exhaust channels for the hydraulic fluid;

a fluid distributor mounted around the axle to rotate together with the frame casing, for the distribution of the hydraulic fluid from said feed channel in the stationary axle into cylinder chambers and away therefrom to said exhaust channel in the stationary axle via openings provided in the cylinder block;

at least two ring-shaped spaces provided between the rotatable fluid distributor and the stationary axle thereby forming a rotatable interface between the stationary axle and the fluid distributor, said spaces being formed in the feed and exhaust channels for the hydraulic fluid, said ring-shaped spaces being formed by stepwise formations in counter surfaces of the fluid distributor and the axle, a first ring-shaped space being formed between a first stepped surface of the fluid distributor and a first stepped counter surface of the axle, a second ring-shaped space being formed between a second stepped surface of the fluid distributor and a second stepped counter surface of the axle; and the area of the end counter surface facing the cylinder block in the ring-shaped spaces being so dimensioned that the force caused by the hydraulic fluid in the ring-shaped spaces presses the fluid distributor against the cylinder block compensating for the force separating the fluid distributor and the cylinder block.

2. Hydraulic motor according to claim 1, characterized in that the ring-shaped spaces in the axial direction are defined by the radial ring surfaces of the counter surfaces of the fluid distributor and the axle and in the radial direction by the axial peripheral surfaces of the counter surfaces of the fluid distributor and the axle.

3. Hydraulic motor according to claim 1, characterized in that the two ring-shaped spaces are provided between the fluid distributor and the axle, the first space thereof being formed in the feed channel before the openings of the cylinder block and the second space in the exhaust channel after the openings of the cylinder block, with respect to the flow direction of the fluid.

4. Hydraulic motor according to claim 3, characterized in that in the first ringshaped space the area of the end surface towards the cylinder block is of the same size as the area of the end surface towards the cylinder block in the second ring-shaped space.

* * * * *